United States Patent [19]

Holik

[11] Patent Number: 4,895,450

[45] Date of Patent: Jan. 23, 1990

[54] WEIGHING, MEASURING, AND MIXING APPARATUS FOR LIGHTWEIGHT CONCRETE

[76] Inventor: Karl Holik, 12858 Pasadena Ave., Litchfield Park, Ariz. 85340

[21] Appl. No.: 345,786

[22] Filed: May 1, 1989

[51] Int. Cl.[4] ..... B28C 7/04

[52] U.S. Cl. ..... 366/18; 73/321; 366/19; 366/141

[58] Field of Search ..... 366/16, 17, 18, 19, 366/20, 21, 141, 152, 162; 73/290 B, 305, 321; 33/722, 723, 724

[56] References Cited

U.S. PATENT DOCUMENTS

| | | | |
|---|---|---|---|
| 2,877,524 | 3/1959 | Bishop | 366/19 |
| 3,140,610 | 7/1964 | Lanham | 73/321 |
| 3,521,367 | 7/1970 | Grynovich | 73/321 |
| 4,276,774 | 7/1981 | McGookin | 73/290 B |
| 4,579,458 | 4/1986 | Ohlson | 366/18 |

*Primary Examiner*—Robert W. Jenkins
*Attorney, Agent, or Firm*—H. Gordon Shields

[57] ABSTRACT

Cement weighing and measuring apparatus includes a primary mixing chamber into which two different types of material are placed, and the materials are measured separately. The different materials are fed into the primary mixing chamber from two separate hoppers, a wet materials hopper and a dry materials hopper. The material in the wet materials hopper is measured by weight and the material in the dry materials hopper is measured by weight and volume. The wet and the dry materials are mixed together in the primary mixing chamber. In addition, other materials, such as foaming agents, bonding agents, etc., may be mixed in with the wet and dry materials in the primary mixing chamber. From the primary mixing chamber, the mixed materials flow outwardly and are conveyed ultimately into molds for curing before use.

7 Claims, 1 Drawing Sheet

WEIGHING, MEASURING, AND MIXING APPARATUS FOR LIGHTWEIGHT CONCRETE

BACKGROUND OF THE INVENTION

1. Field of the Invention

This invention relates to cement mixing, and, more particularly, to mixing ingredients for cementitious products in which ingredients are measured by weight and by volume in one container, and where the ingredients in a second container are measured by weight.

2. Description of the Prior Art

For lightweight concrete products, cement and filler material are mixed, along with water, and other agents. In addition, previously hydrated cement and filler materials, previously mixed, may also be mixed with newly added filler material before being combined with water and cement for final mixing before being cast into molds.

The measuring of the various ingredients, prior to the final mixing, is, in the prior art, very cumbersome and labor intensive. The materials are generally measured either by weight or by volume, and then the various materials are combined for ultimate mixing, To have to weigh some of the ingredients and to measure by volume some of the other ingredients, and the separate handling steps in the separate measurement steps, can take an appreciable amount of time and manpower to accomplish. This is so particularly using previously mixed materials which consist of an unknown value of hydrated cement and fillers which have to be separated before measuring. Fillers are added by volume while hydrated cement must be added by its weight.

The apparatus of the present invention overcomes the deficiencies of the prior art by providing two different chambers into which ingredients are placed before being transferred from the two hoppers into a central mixing chamber. In one hopper, filler material contained in hydrated cement and fresh filler material is measured by volume and the hydrated cement is measured by weight. The measuring and weighing steps are automatically accomplished by the apparatus of the present invention. In the second hopper, water and cement are measured by weight, and the water and cement are mixed before being transferred to the central mixing chamber.

SUMMARY OF THE INVENTION

The invention described and claimed herein includes a hopper into which two or more different types of materials are placed. Weighing apparatus is includes for providing the measurement of material by weight, and a volumetric measuring apparatus is provided to measure material by volume. The materials are then transferred to a central mixing chamber. A second hopper is provided and also receives two ore more different types of materials, which require measuring by weight. Accordingly, weight measuring apparatus is provided for that hopper. From the central mixer, the mixed cement product is transferred to molds for curing.

Among the objects of the present invention are the following:

To provide new and useful weighing and measuring apparatus;

To provide new and useful apparatus for measuring a first ingredient by weight and for measuring a second ingredient by volume;

To provide new and useful cement measuring apparatus in which component ingredients are measured by weight and by volume; and To provide new and useful cement mixing apparatus having a central mixing chamber which receives cement ingredients for mixing from at least two hoppers, and the ingredients of one of the hoppers are mixed by weight and the ingredients of the other hopper are mixed by weight and by volume.

DESCRIPTION OF THE PREFERRED EMBODIMENT

Figure 1:
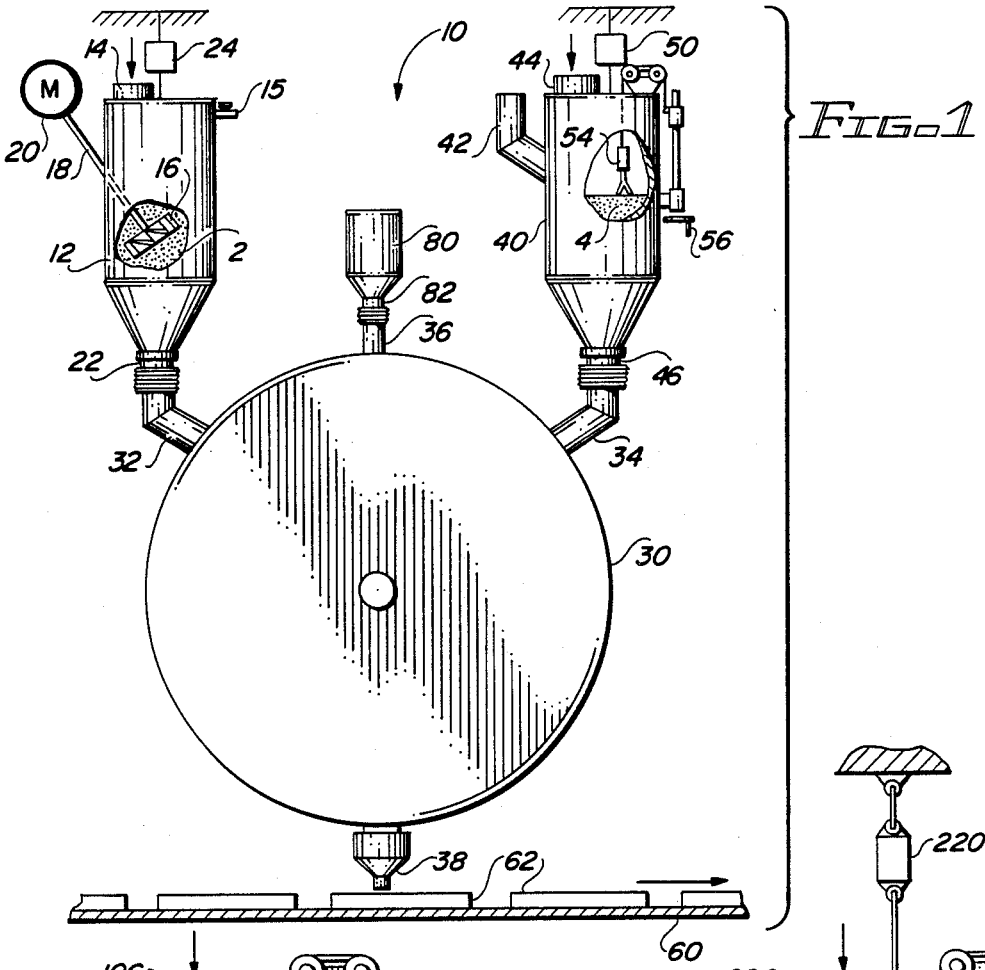
FIG. 1 is a schematic representation of the apparatus of the present invention.

FIG. 1 is a schematic representation of the apparatus of the present invention, including a generally cylindrical wet mixing chamber or hopper 12, a dry or aggregate mixing chamber or hopper 40, and a primary mixing chamber or hopper 30. The output from both the wet mixing chamber or hopper 12 and the dry aggregate mixing chamber or hopper 40 flow into the primary mixing chamber 30.

The wet mixing chamber 12 includes an input spout 14 at the top of the chamber or hopper. Both water and cement 2 flow into the hopper or chamber 12 through the input spout 14. Alternatively, water may be filled by means of a nozzle arrangement inside the hopper 40 through a water connection 15. This provides cleaning of the hopper's inside walls when water is filled for each batching cycle. A mixer 16 is disposed in the hopper 12 for mixing the water and cement 2. The mixer is connected by a shaft 18 to a motor 20.

At the bottom or lower portion of the hopper 12 is an output conduit 22. The output conduit 22 is connected to an input conduit or spout 32 of the primary mixing chamber 30.

A scale or weight cell 24 is connected to the hopper 22 to weigh the hopper 12, or rather to weigh the material 2 in the hopper 12, namely the water and cement. Since the weight of the cement and water 2 is of primary concern, the volume of the water and cement 2 may be ignored or disregarded. Accordingly, only a scale is required for measuring purposes for the cement and water mixing hopper 12.

The dry or filler or aggregate hopper 40 is also of a generally cylindrical configuration. The hopper 40 includes a filler or input spout or conduit through which scrap filler or aggregate material flows into the hopper 40. The scrap aggregate or filler material includes pieces or particles of lightweight concrete material, cement dust, and the like, as well as pieces of hydrated cement. Weight-wise, the latter material is of concern.

A scale or weight cell 50 is secured to the hopper 40 to weigh the scrap material introduced into the hopper 40 through the conduit 42, the heaviest of which is the hydrated cement scrap.

New filler material, such as polystyrene beads and the like, flows into the hopper 40 through a second input spout or conduit 44. The new filler or aggregate material is relatively lightweight material, and it is introduced separately from the scrap material.

Filler material, old and new, is identified in FIG. 1 by reference numeral 4.

Since the new aggregate material 4 introduced into the hopper 40 through the conduit or spout 44, and the filler material contained in the scrap previously filled through spout 42, is relatively lightweight, as compared to the weight of hydrated cement contained in the scrap material introduced into the hopper 40 through the spot 42, the weight of the aggregate materials 4 in the hopper 40 may be disregarded. Accordingly, he primary concern with respect to the measurement of the aggregate materials 4 in the hopper 40 is its volume.

A level sensor 54 is disposed in the hopper 40 to sense the level, or the volume, of the material 4 in the hopper 40. The level sensor 54 is appropriately connected to a level adjustment drive 56, thus making it possible to predetermine a certain volume.

An output conduit 46 at the bottom of the hopper 40 is connected to an input conduit 34 of the primary mixing chamber 30. The output from the dry aggregate hopper 40 flows into the primary mixing chamber or hopper 30 and is there mixed with the premixed cement mortar from the wet hopper 12.

From the primary mixing chamber or hopper 30, the ready-mixed lightweight concrete, including the hydrated cement 2, the combined scrap material and relatively lightweight aggregate 4, flows through an output or discharge conduit 38 to a plurality of molds62 disposed on a conveyor 60. The molds are conveyed to a curing area where the cement and aggregate material cures and is then ready for transporting to construction sites.

Figure 2:
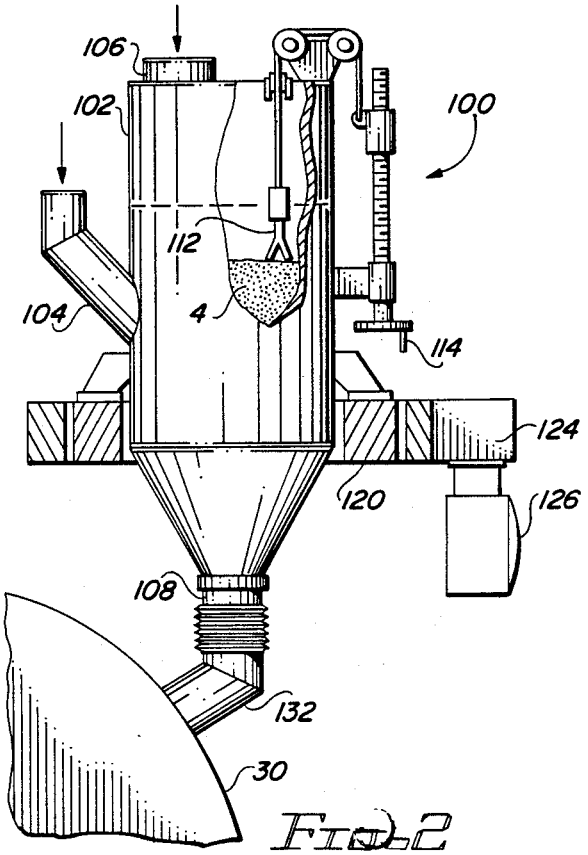
FIG. 2 is an enlarged view in partial section of a portion of the apparatus of FIG. 1.

FIG. 2 is a schematic representatin of an alternate embodiment 100 of the dry hopper of the present invention. A dry hopper 100, which is of a generally cylindrical configuration is shown. Connected to the hopper 102 is an input conduit 104 through which scrap material, such as broken pieces of lightweight concrete, cement dust, hydrated cement, and the like, as discussed above, flows to the hopper 102. The content of the hydrated cement in scrap material is of substantial weight, and accordingly is weighed.

A second input conduit 106 is connected to the hopper 102 through which lightweight aggregate material, as discussed above, flows into the hopper 102.

Both the materials flow out of the hopper 102 through an output or discharge conduit 108. The output conduit or spout 108 is connected to an input conduit 132 of the primary mixing chamber 30.

A level sensor 112 is disposed in the hopper 102 for sensing the level of the relatively lightweight aggregate material 4 and the lightweight filler contained in scrap material in the hopper 102. The level sensor is connected to a level adjustment drive 114. Since only the volume of the aggregate materials 4 is of concern, its weight is disregarded.

The hopper 102 is supported by appropriate support elements 120. A scale 124 is in turn connected to the support elements 120. A readout 126 for the scale 124 provides visual indication of the weight of the scrap concrete material in the hopper 102. Since the weight of the scrap concrete material is of primary concern, and its volume is small, the volume can be disregarded.

In the embodiment of FIG. 2, the hopper apparatus 102 provides an alternative support and weighing system for the dry hopper. It thus differs from the hopper apparatus 40 of FIG. 1 primarily in the support and weighing system.

Figure 3:
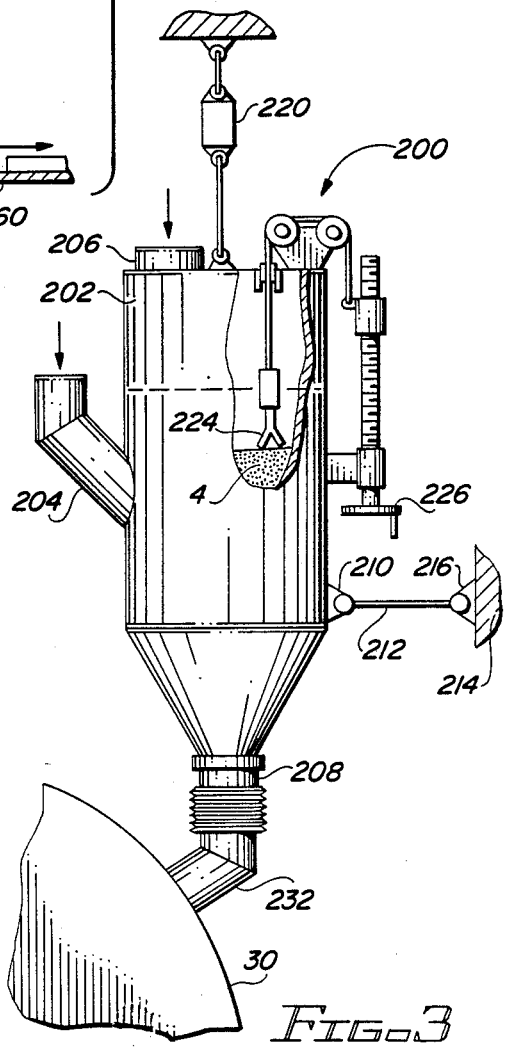
FIG. 3 is an enlarged view of an alternate embodiment of the apparatus of FIG. 2.

FIG. 3 is a schematic representation of another alternate embodiment 200 of a dry hopper 202 of the apparatus of the present invention. The primary difference between the hopper apparatus 102 and the hopper apparatus 202 is in the support of the hopper 202 and in the weighing elements for the hopper 202.

The hopper 202 includes an input spout or conduit 204 through which dry scrap concrete and other scrap material flows. A second input spout or conduit 206 is disposed at the top or upper portion of the hopper 202 through which lightweight aggregate or filler material flows into the hopper. At the bottom of the hopper 202 is a discharge or output spout or conduit 208 through which both the scrap aggregate material and the new lightweight aggregate material flows to the primary mixing chamber 30.

The hopper 202 is supported by a wall or support structure 214 through a support plate 210, a beam or the like 212, and a connecting plate 216.

A scale 220 is connected to the hopper 202 to weigh the contents of the hopper 202, or rather to weigh the hydrated cement scrap material in the hopper 202. For measuring the volume of the lightweight aggregate in the hopper 202, a level sensor 224 in the hopper is appropriately connected to a level adjustment drive 226. Again, the weight of the aggregate 4 is disregarded, and the small volume of the hydrated cement contained in the scrap material is disregarded.

Returning again to FIG. 1, a third hopper 80 is shown connected to the primary mixing chamber 30. The hopper 80 is relatively small, as compared to the hoppers 12 and 40.

The hopper 80 is for additives for the lightweight concrete product required during the mixing of the ingredients or materials in the primary chamber 30. Such additives include foaming agents, bonding agents, and the like. The additives flow from the additive hopper 80 into the primary hopper or chamber from a discharge conduit 82 and into an input conduit 36.

As will be understood, there are appropriate control valves and the like for controlling the flow of the various materials into and out of the various hoppers 12, 40, 80, and 30, and the alternate embodiment hoppers 102 and 202. Such valves, etc., are well known and understood in the art and accordingly are not shown. Moreover, the connecting elements for the various hoppers or chambers are not discussed in detail since they also are well known and understood in the art.

While the principles of the invention have been made clear in illustrative embodiments, there will be immediately obvious to those skilled in the art many modifications of structure, arrangement, proportions, the elements, materials, and components used in the practice of the invention, and otherwise, which are particularly adapted to specific environments and operative requirements without departing from those principles. The appended claims are intended to cover and embrace any and all such modifications, within the limits only of the true spirit and scope of the invention.

What I claim is:

1. Measuring and weighing apparatus comprising, in combination:

first hopper means for receiving first materials;

first weighing means for weighing the first materials in the first hopper means;

first measuring means for measuring the volume of the first materials in the first hopper means;

second hopper means for receiving second materials;

second weighing means for weighing the second materials in the second hopper means; and third hopper means for receiving and mixing the first materials from the first hopper means and the second materials from the second hopper means.

2. The apparatus of claim 1 in which the first hopper means comprises a hopper for receiving dry materials.

3. The apparatus of claim 2 in which the second hopper means comprises a hopper for receiving wet materials.

4. Measuring and weighing apparatus comprising, in combination:

wet hopper means for receiving and mixing hydrated cement materials;

means for weighing the hydrated cement materials;

dry hopper means for receiving and mixing dry aggregate materials;

means for weighing at least a portion of the dry aggregate materials;

means for measuring the volume of the dry aggregate materials; and primary mixing chamber means for receiving and mixing the materials from the wet hopper means and the dry hopper means.

5. The apparatus of claim 5 in which the primary mixing chamber means includes a primary mixing chamber connected to the wet hopper means and the dry hopper means.

6. The apparatus of claim 5 in which the primary mixing chamber means includes means for disposing the mixed materials from the primary mixing chamber.

7. The apparatus of claim 6 in which the primary mixing chamber means further includes additive hopper means connected to the primary mixing chamber for providing additives to the primary mixing chamber for the materials being mixed.

* * * * *